US005329100A

United States Patent [19]

Lee

[11] Patent Number: 5,329,100

[45] Date of Patent: Jul. 12, 1994

[54] CIRCUIT FOR COMPENSATING FOR OUTPUT OF HIGH FREQUENCY INDUCTION HEATING COOKER

[75] Inventor: Min K. Lee, Kyungsangnam-Do, Rep. of Korea

[73] Assignee: Goldstar Co., Ltd., Rep. of Korea

[21] Appl. No.: 16,016

[22] Filed: Feb. 10, 1993

[30] Foreign Application Priority Data

Feb. 11, 1992 [KR] Rep. of Korea ..... 1937/1992

[51] Int. Cl.[5] ..... H05B 6/12

[52] U.S. Cl. ..... 219/626; 219/664; 219/665; 363/49; 323/285

[58] Field of Search ..... 219/10.77, 10.493, 490, 219/497, 626, 661, 663, 664, 665; 363/97, 49, 21; 323/299, 265, 282, 285

[56] References Cited

U.S. PATENT DOCUMENTS

| | | | |
|---|---|---|---|
| 4,456,807 | 6/1984 | Ogino et al. | 219/10.77 |
| 4,467,165 | 8/1984 | Kiuchi et al. | 219/10.77 |
| 4,638,135 | 1/1987 | Aoki | 219/10.493 |
| 4,686,340 | 8/1987 | Fukasawa | 219/10.77 |
| 4,764,652 | 8/1988 | Lee . | |
| 4,810,847 | 3/1989 | Ito | 219/10.77 |
| 5,004,881 | 4/1991 | Lee . | |

FOREIGN PATENT DOCUMENTS

| | | |
|---|---|---|
| 2836610 | 3/1980 | Fed. Rep. of Germany . |
| 3917479 | 12/1989 | Fed. Rep. of Germany . |
| 4040052 | 6/1991 | Fed. Rep. of Germany . |
| 2073967 | 9/1980 | United Kingdom . |
| 2062985 | 5/1981 | United Kingdom .. |
| 2153111 | 1/1985 | United Kingdom . |

OTHER PUBLICATIONS

H. Omori et al., "New Single-Ended Resonant Inverter Circuit and System for Induction-Heating Cooking Apparatus"-International Journal of Electronics-vol. 67, No. 2, Aug. 1989, London GB pp. 277-296.

*Primary Examiner*—Philip H. Leung

*Attorney, Agent, or Firm*—Ostrolenk, Faber, Gerb & Soffen

[57] ABSTRACT

A circuit for compensating for the output of a high frequency induction heating cooker, comprising a rectifying circuit for rectifying an external AC input power into a DC power and applying the DC power to a working coil, an output regulation signal generating circuit for generating an output regulation signal as a result of the comparison of an input voltage and an output regulation voltage, a start driving circuit for generating a start drive voltage, a triangular wave generating circuit being triggered in response to a driven state of the working coil to generate a triangular wave signal, a switching circuit for start-driving the working coil in response to the start drive voltage, comparing the output regulation signal with the triangular wave signal and switching the driving of the working coil in accordance with the compared result, a voltage detecting circuit for detecting a voltage being applied from the rectifying circuit to the working coil and inversion-amplifying the detected voltage, an output control unit for generating output regulation data according to a user's selection, and a voltage dividing circuit for dividing an output voltage from the voltage detecting circuit according to the output regulation data and outputting the divided voltage as the output regulation voltage.

4 Claims, 3 Drawing Sheets

FIG. 3

| P/L | P3 | P2 | P1 | REMARK |
|---|---|---|---|---|
| 1 | L | L | H | TIME DUTY |
| 2 | L | H | L | 〃 |
| 3 | L | H | H | 〃 |
| 4 | H | L | L | 〃 |
| 5 | H | H | L | 〃 |
| TURBO | H | H | H | 〃 |
| OFF | L | L | L | |

CIRCUIT FOR COMPENSATING FOR OUTPUT OF HIGH FREQUENCY INDUCTION HEATING COOKER

BACKGROUND OF THE INVENTION

1. Field of the Invention

The present invention relates in general to the regulation of the output of a high frequency induction heating cooker, and more particularly to a circuit for compensating for the output of a high frequency induction heating cooker wherein the output is maintained at a constant value desired by the user although an input voltage is varied.

2. Description of the Prior Art

Referring to FIG. 1, there is shown a block diagram of a conventional circuit for compensating for the output of a high frequency induction heating cooker. As shown in this drawing, the conventional output compensating circuit comprises a working coil W/C for generating a magnetic force to heat a conductive cooking container, a rectifying circuit 10 for rectifying an external alternating current (AC) input power into a direct current (DC) power, filtering the DC power and applying the filtered DC power to the working coil W/C, an input current detecting circuit 20 for detecting a voltage proportioned to current of the AC input power through a current transformer CT, and an output regulation signal generating circuit 30 for comparing the detected voltage from the input current detecting circuit 20 with an output regulation voltage Vref1 which is regulated by the user and generating an output regulation signal in accordance with the compared result.

The rectifying circuit 10 includes a bridge diode BD for rectifying the external AC input power into the DC power and a choke coil CH and a condenser C2 for cooperating to filter the DC power from the bridge diode BD and apply the filtered DC power to the working coil W/C.

The output regulation signal generating circuit 30 includes a first comparator 31 for comparing the detected voltage from the input current detecting circuit 20 with the output regulation voltage Vref1 and an integrator 32 for integrating an output signal from the first comparator 31 and outputting the integrated signal as the output regulation signal.

The conventional output compensating circuit also comprises a start driving circuit 40 for comparing the detected voltage from the input current detecting circuit 20 with a predetermined container discrimination voltage Vref2 and controlling the operation of the integrator 32 in the output regulation signal generating circuit 30 and generating a start drive voltage in accordance with the compared result, a triangular wave generating circuit 50 being triggered in response to a driven state of the working coil W/C to generate a triangular wave signal, and a switching circuit 60 for start-driving the working coil W/C in response to the start drive voltage from the start driving circuit 40, comparing the output regulation signal from the output regulation signal generating circuit 30 with the triangular wave signal from the triangular wave generating circuit 50 and switching the driving of the working coil W/C in accordance with the compared result.

The start driving circuit 40 includes a second comparator 41 for comparing the detected voltage from the input current detecting circuit 20 with the predetermined container discrimination voltage Vref2 and controlling the operation of the integrator 32 in the output regulation signal generating circuit 30 in accordance with the compared result and a start drive voltage generator 42 for generating the start drive voltage in response to an output signal from the second comparator 41.

The triangular wave generating circuit 50 includes a trigger circuit 51 for generating a trigger signal in response to the driven state of the working coil W/C and a triangular wave generator 52 for generating the triangular wave signal in response to the trigger signal from the trigger circuit 51.

The switching circuit 60 includes a third comparator 61 for comparing the output regulation signal from the output regulation signal generating circuit 30 with the triangular wave signal from the triangular wave generating circuit 50, a power transistor Q1 for switching the driving of the working coil W/C, a delay circuit 62 for delaying an output signal from the third comparator 61 by a predetermined time period, and a driver 63 for driving the power transistor Q1 in response to an output signal from the delay circuit 62.

A resonance condenser C1 is connected in parallel to the working coil W/C to resonate with the choke coil CH and a diode D1 is connected reversely and in parallel to the transistor Q1 to protect the transistor Q1.

The operation of the conventional output compensating circuit with the above-mentioned construction will hereinafter be described.

When the user turns on a power switch (not shown) of the high frequency induction heating cooker, the external AC power is supplied to the high frequency induction heating cooker. The external AC input power is full-wave rectified by the bridge diode BD and then filtered by the choke coil CH and the condenser C2. The filtered DC power is applied to the working coil W/C.

At this time, at an initial state, no current flows through the working coil W/C. As a result, the input current detecting circuit 20 outputs a zero voltage to inverting input terminals (−) of the first and second comparators 31 and 41. Then, a high signal is outputted from the second comparator 41, a non-inverting input terminal (+) of which is applied with the predetermined container discrimination voltage Vref2, thereby causing the integrator 32 to be disabled. Also, the start drive voltage is generated from the start drive voltage generator 42 and then applied to a non-inverting input terminal (+) of the third comparator 61, thereby causing a high signal to be outputted from the third comparator 61. The high signal from the third comparator 61 is applied to a base of the transistor Q1 through the delay circuit 62 and the driver 63. As a result, the transistor Q1 is turned on.

The turning-on of the transistor Q1 causes current to flow through the working coil W/C, resulting in the start driving of the working coil W/C. The current flowing through the working coil W/C is detected by the current transformer CT and the proportioned voltage is then detected by the input current detecting circuit 20.

On the other hand, the driving of the working coil W/C causes the trigger circuit 51 to generate the trigger signal. In response to the trigger signal from the trigger circuit 51, the triangular wave generator 52 generates the triangular wave signal, which is then applied to an inverting input terminal (−) of the third comparator 61.

At this time, the detected voltage from the input current detecting circuit, 20 is higher than the predetermined container discrimination voltage Vref2 and a low signal is thus outputted from the second comparator 41. As a result, the integrator 32 is enabled and the start drive voltage generator 42 is disabled. The detected voltage from the input current detecting circuit 20 is also compared in the first comparator 31 with the output regulation voltage Vref1 which is regulated by the user and a signal of a virtual ground level is thus outputted from the first comparator 31. The output signal from the first comparator 31 is integrated by the integrator 32 and then applied to the non-inverting input terminal (+) of the third comparator 61.

When the triangular wave signal from the triangular wave generator 52 is higher than the output signal from the integrator 32, a low signal is outputted from the third comparator 61 and then applied to the base of the transistor Q1 through the delay circuit 62 and the driver 63. As a result, the transistor Q1 is turned off.

Thereafter, when the triangular wave signal from the triangular wave generator 52 is lower than the output signal from the integrator 32, a high signal is outputted from the third comparator 61 and then applied to the base of the transistor Q1 through the delay circuit 62 and the driver 63. As a result, the transistor Q1 is turned on.

The turning-on/off of the transistor Q1 are controlled repeatedly in the above-mentioned manner, resulting in generation of the magnetic force in the working coil W/C. The surface resistance of the conductive container becomes large due to the magnetic force from the working coil W/C, so that heat is generated from the conductive container. In result, the cooking of food is performed by the heat.

However, the conventional circuit for compensating for the output of the high frequency induction heating cooker has a disadvantage in that it is controlled by the detected voltage from the input current detecting circuit and the output regulation voltage which is regulated by the user. Namely, since the drive voltage to the working coil is varied as a variation in the AC input power voltage, the output of the high frequency induction heating cooker is varied. For this reason, the output of the high frequency induction heating cooker cannot be controlled at a constant value desired by the user.

SUMMARY OF THE INVENTION

Therefore, the present invention has been made in view of the above problem, and it is an object of the present invention to provide a circuit for compensating for the output of a high frequency induction heating cooker wherein an output regulation voltage which is regulated by the user is considered for compensation for a variation in an input voltage so that the output is maintained at a constant value desired by the user although the input voltage is varied.

In accordance with the present invention, the above and other objects can be accomplished by a provision of a circuit for compensating for the output of a high frequency induction heating cooker, comprising: rectifying means for rectifying an external AC input power into a DC power and applying the DC power to a working coil; input current detecting means for detecting a voltage proportioned to current of the AC input power; output regulation signal generating means for comparing the detected voltage from said input current detecting means with an output regulation voltage which is regulated by the user and generating an output regulation signal in accordance with the compared result; start driving means for comparing the detected voltage from said input current detecting means with a predetermined container discrimination voltage and generating a start drive voltage in accordance with the compared result; triangular wave generating means being triggered in response to a driven state of said working coil to generate a triangular wave signal; switching means for start-driving said working coil in response to the start drive voltage from said start driving means, comparing the output regulation signal from said output regulation signal generating means with the triangular wave signal from said triangular wave generating means and switching the driving of said working coil in accordance with the compared result; voltage detecting means for detecting a voltage being applied from said rectifying means to said working coil and inversion-amplifying the detected voltage; output control means for generating output regulation data according to a user's selection; and voltage dividing means for dividing an output voltage from said voltage detecting means according to the output regulation data from said output control means and outputting the divided voltage as the output regulation voltage to said output regulation signal generating means.

BRIEF DESCRIPTION OF THE DRAWINGS

The above and other objects, features and advantages of the present invention will be more clearly understood from the following detailed description taken in conjunction with the accompanying drawings, in which:

FIG. 3 is a logic table illustrating output regulation data which are outputted from an output control unit in the high frequency induction heating cooker in FIG. 2.

DETAILED DESCRIPTION OF THE PREFERRED EMBODIMENTS

Figure 1:
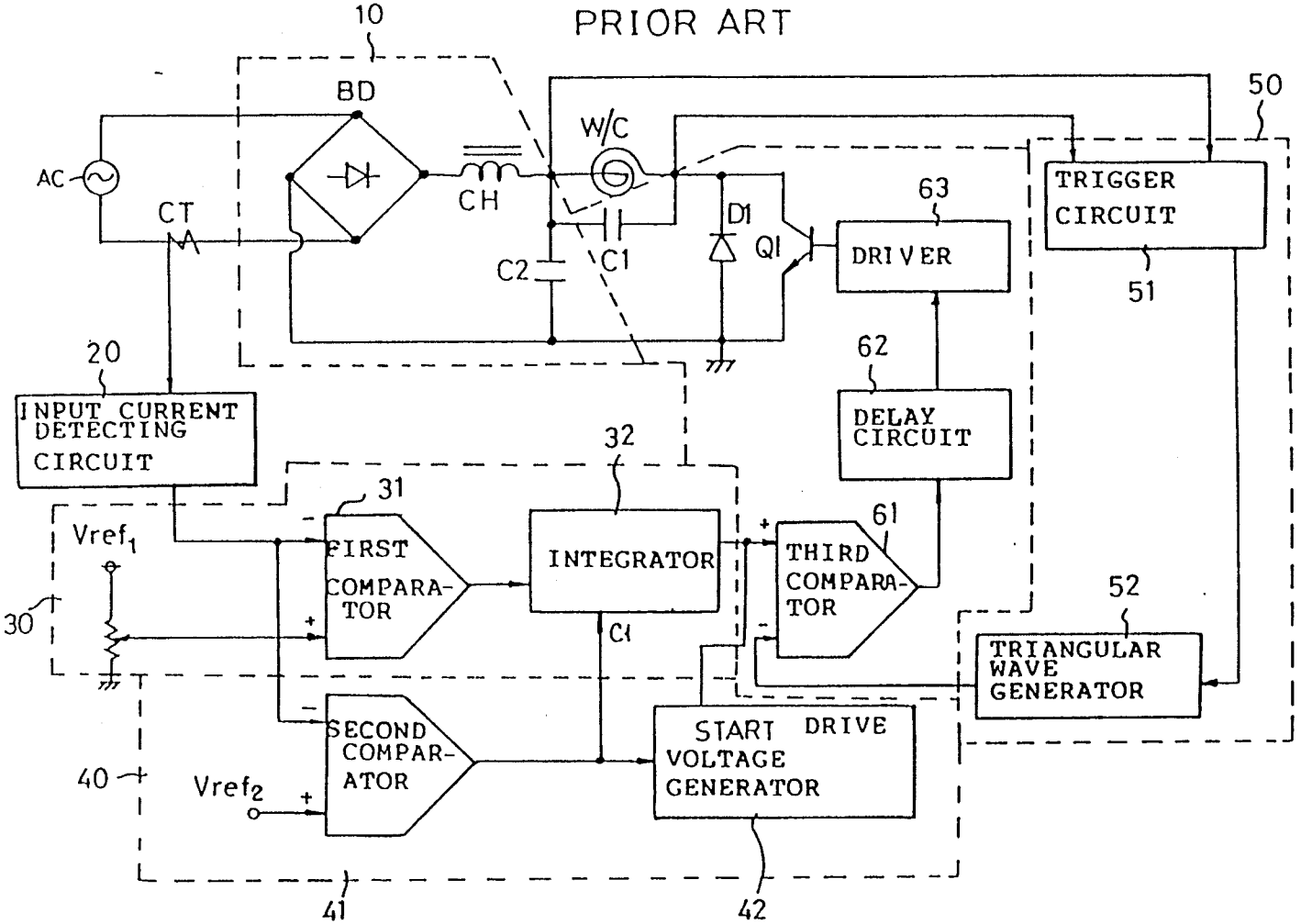
FIG. 1 PRIOR ART
FIG. 1 is a block diagram of a conventional circuit for compensating for the output of a high frequency induction heating cooker.
Figure 2:
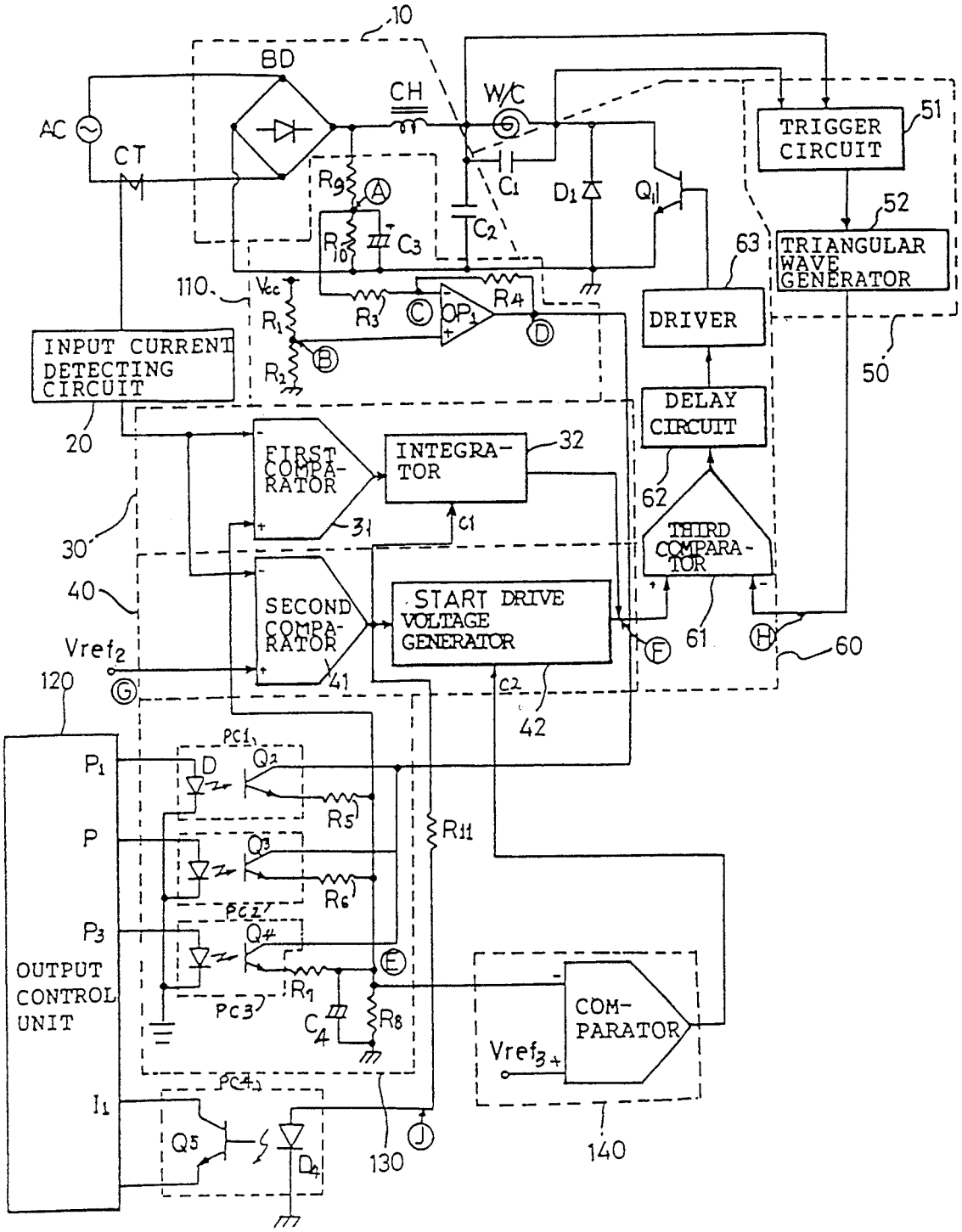
FIG. 2 is a block diagram of a circuit for compensating for the output of a high frequency induction heating cooker in accordance with the present invention.

Referring to FIG. 2, there is shown a block diagram of a circuit for compensating for the output of a high frequency induction heating cooker in accordance with the present invention. As shown in this drawing, the output compensating circuit of the present invention comprises a working coil W/C for generating a magnetic force to heat a conductive cooking container, a rectifying circuit 10 for rectifying an external alternating current (AC) input power into a direct current (DC) power and applying the DC power to the working coil W/C, an input current detecting circuit 20 for detecting a voltage proportioned to current of the AC input power through a current transformer CT, and an output regulation signal generating circuit 30 for comparing the detected voltage from the input current detecting circuit 20 with an output regulation voltage which is regulated by the user and generating an output regulation signal in accordance with the compared result.

The output regulation signal generating circuit 30 includes a first comparator 31 for comparing the detected voltage from the input current detecting circuit 20 with the output regulation voltage and an integrator 32 for integrating an output signal from the first comparator 31 and outputting the integrated signal as the output regulation signal.

The output compensating circuit of the present invention also comprises a start driving circuit 40 for comparing the detected voltage from the input current detecting circuit 20 with a predetermined container discrimination voltage Vref2 and controlling the operation of the integrator 32 in the output regulation signal generating circuit 30 and generating a start drive voltage in accordance with the compared result, a triangular wave generating circuit 50 being triggered in response to a driven state of the working coil W/C to generate a triangular wave signal, and a switching circuit 60 for start-driving the working coil W/C in response to the start drive voltage from the start driving circuit 40, comparing the output regulation signal from the output regulation signal generating circuit 30 with the triangular wave signal from the triangular wave generating circuit 50 and switching the driving of the working coil W/C in accordance with the compared result.

The start driving circuit 40 includes a second comparator 41 for comparing the detected voltage from the input current detecting circuit 20 with the predetermined container discrimination voltage Vref2 and controlling the operation of the integrator 32 in the output regulation signal generating circuit 30 in accordance with the compared result and a start drive voltage generator 42 for generating the start drive voltage in response to an output signal from the second comparator 41.

The triangular wave generating circuit 50 includes a trigger circuit 51 for generating a trigger signal in response to the driven state of the working coil W/C and a triangular wave generator 52 for generating the triangular wave signal in response to the trigger signal from the trigger circuit 51.

The switching circuit 60 includes a third comparator 61 for comparing the output regulation signal from the output regulation signal generating circuit 30 with the triangular wave signal from the triangular wave generating circuit 50, a power transistor Q1 for switching the driving of the working coil W/C, a delay circuit 62 for delaying an output signal from the third comparator 61 by a predetermined time period, and a driver 63 for driving the power transistor Q1 in response to an output signal from the delay circuit 62.

The output compensating circuit of the present invention also comprises a voltage detecting circuit 110 for detecting a voltage being applied from the rectifying circuit 10 to the working coil W/C and inversion-amplifying the detected voltage, an output control unit 120 for generating output regulation data according to a user's selection, and a voltage dividing circuit 130 for dividing an output voltage from the voltage detecting circuit 110 according to the output regulation data from the output control unit 120 and outputting the divided voltage as the output regulation voltage to the first comparator 31 in the output regulation signal generating circuit 30.

The voltage detecting circuit 110 includes a resistor R9 connected to the output of a bridge diode BD in the rectifying circuit 10, a resistor R10 connected in series to the resistor R9, a condenser C3 connected in parallel to the resistor R10, resistors R1 and R2 connected in series between a power source terminal Vcc and a ground terminal, and an operational amplifier OP1 having its inverting input terminal (−) connected to a connection point A of the resistors R9 and R10 and the condenser C3 through a resistor R3, its non-inverting input terminal (+) connected to a connection point B of the resistors R1 and R2 and its output terminal connected to the inverting input terminal (−) through a resistor R4. With this construction, the voltage detecting circuit 110 outputs a voltage inversely proportioned to a variation in the input voltage.

The output control unit 120 generates the output regulation data in response to a key signal which is generated according to the user's selection. Also, the output control unit 120 detects the output signal from the second comparator 41 in the start driving circuit 40 through a photocoupler PC4 and controls the output of the output regulation data upon the start driving of the working coil W/C in accordance with the detected signal.

The voltage-dividing circuit 130 includes a plurality of photocouplers PC1, PC2 and PC3 connected in parallel to the output of the voltage detecting circuit 110. The photocouplers PC1–PC3 are driven by the output regulation data from the output control unit 120.

The voltage dividing circuit 130 also includes a plurality of resistors R5, R6 and R7 each connected to an output terminal of a corresponding one of the photocouplers PC1–PC3. The resistors R5–R7 are of different resistances.

The voltage dividing circuit 130 also includes a condenser C4 and a resistor R8 connected in parallel to each other and commonly to the resistors R5–R7. The condenser C4 and the resistor R8 cooperates to divide the output voltage from the voltage detecting circuit 110 through the resistors R5–R7 upon the driving of the photocouplers PC1–PC3 and apply the divided voltage as the output regulation voltage to the first comparator 31 in the output regulation signal generating circuit 30.

The output compensating circuit of the present invention also comprises an output off control device 140 for comparing the output regulation voltage from the voltage dividing circuit 130 with a predetermined reference voltage and disabling the start drive voltage generator 42 in the start driving circuit 40 upon the output-off of the high frequency induction heating cooker in accordance with the compared result.

The operation of the output compensating circuit with the above-mentioned construction in accordance with the present invention will hereinafter be described in detail.

When the user turns on a power switch (not shown) of the high frequency induction heating cooker, the external AC power is supplied to the high frequency induction heating cooker. The external AC input power is rectified by the rectifying circuit 10 and then applied to the working coil W/C. At this time, the start drive voltage is generated from the start driving circuit 40, thereby causing the transistor Q1 in the switching circuit 60 to be turned on.

The turning-on of the transistor Q1 causes current to flow through the working coil W/C, resulting in the start driving of the working coil W/C. The current flowing through the working coil W/C is detected by the current transformer CT and the proportioned voltage is then detected by the input current detecting circuit 20.

The detected voltage from the input current detecting circuit 20 is compared in the first comparator 31 in the output regulation signal generating circuit 30 with the output regulation voltage from the voltage dividing circuit 130 and a signal of a virtual ground level is thus outputted from the first comparator 31. The output signal from the first comparator 31 is integrated by the integrator 32 and then applied to a non-inverting input terminal (+) of the third comparator 61 in the switching circuit 60.

The driving of the working coil W/C also causes the trigger circuit 51 to generate the trigger signal. In response to the trigger signal from the trigger circuit 51, the triangular wave generator 52 generates the triangular wave signal, which is then applied to an inverting input terminal (−) of the third comparator 61.

Then, the third comparator 61 compares the output signal from the integrator 32 with the triangular wave signal from the triangular wave generator 52 and applies a signal as a result of the comparison to a base of the transistor Q1 through the delay circuit 62 and the driver 63. When the triangular wave signal from the triangular wave generator 52 is lower than the output signal from the integrator 32, a high signal is outputted from the third comparator 61 and then applied to the base of the transistor Q1 through the delay circuit 62 and the driver 63. As a result, the transistor Q1 is turned on, resulting in the driving of the working coil W/C. When the triangular wave signal from the triangular wave generator 52 is higher than the output signal from the integrator 32, a low signal is outputted from the third comparator 61 and then applied to the base of the transistor Q1 through the delay circuit 62 and the driver 63. As a result, the transistor Q1 is turned off, resulting in no driving of the working coil W/C.

The turning-on/off of the transistor Q1 are controlled repeatedly in the above-mentioned manner, resulting in generation of the magnetic force in the working coil W/C. The surface resistance of the conductive container becomes large due to the magnetic force from the working coil W/C, so that heat is generated from the conductive container. In result, the cooking of food is performed by the heat.

The voltage being applied to the working coil W/C is detected by the voltage detecting circuit 110 which is proposed by the present invention and is operated in the below manner.

Upon input of the commercial AC power, a voltage appears at the connection point A of the resistors R9 and R10 connected between the both sides of the bridge diode BD in proportion to the input voltage. The voltage at the connection point A is smoothed by the ground condenser C3. At this time, a constant voltage at the connection point B of the resistors R1 and R2 is applied to the non-inverting input terminal (+) of the operational amplifier OP1 and the voltage at the connection point A is applied to the inverting input terminal (−) thereof through the resistor R3. Hence, current $I_1$ flowing through a connection point C of the inverting input terminal (−) can be expressed by the following equation (1):

$$I_1=(V_A-V_B)/R3 \ldots \quad (1)$$

where, the connection points B and C are at the virtual ground states and $V_A$ and $V_B$ designates the voltages at the connection points A and B, respectively.

Also, current flowing through the resistor R4 is the same as the current $I_1$. Hence, a voltage $V_D$ at an output point D of the operational amplifier OP1 can be expressed by the following equation (2):

$$V_D=V_B-I_1R4 \ldots \quad (2)$$

The following equation (3) is obtained by substituting the equation (1) for the equation (2):

$$V_D=V_B-[(V_A-V_B)/R3]R4 \ldots \quad (3)$$

It can be seen from the above equation (3) that the voltage $V_D$ becomes low as the voltage $V_A$ becomes high. Namely the output voltage $V_D$ from the voltage detecting circuit 110 becomes low as the input voltage $V_A$ becomes high while high as the input voltage $V_A$ becomes low. The output voltage $V_D$ from the voltage detecting circuit 110 is applied commonly to the photocouplers PC1–PC3 in the voltage dividing circuit 130.

Then, the output control unit 120 outputs the output regulation data for regulation of a power level P/L, as shown in FIG. 3. For example, when the power level is 3, the output control unit 120 outputs the output regulation data of high level through its output ports P1 and P2, thereby causing light emitting diodes D1 and D2 to be turned on and light receiving transistors Q2 and Q3 to be turned on. As a result, a voltage $V_E$ divided by the resistors R5, R6 and R8 is applied as the output regulation voltage to the non-inverting input terminal (+) of the first comparator 31.

Because the output voltage $V_D$ from the voltage detecting circuit 110 is in inverse proportion to the input voltage $V_A$, the output regulation voltage $V_E$ is in inverse proportion to the input voltage $V_A$, too. For this reason, when the output regulation voltage $V_E$ from the voltage dividing circuit 130 becomes low, the output level of the integrator 32 becomes low due to the virtual ground effect of the two input terminals of the first comparator 31. In result, the output of the high frequency induction heating cooker becomes low.

Noticeably, a low voltage is used in the output control unit 120 and a high voltage is used in the voltage detecting circuit 110 and the output regulation signal generating circuit 30. In this connection, the output control unit 120, the voltage detecting circuit 110 and the output regulation signal generating circuit 30 are electrically isolated from one another by the photocouplers PC1–PC3 in the voltage dividing circuit 130.

Also, the start drive voltage generator 42 in the start driving circuit 40 is controlled by the output of the output off control device 140. Hence, the start drive voltage generator 42 is activated only when the voltage at the point E is higher than the predetermined reference voltage Vref3. That is, at the output-off state of the cooker, the output regulation data from the output ports P1–P3 of the output control unit 120 are all low and thus the photocouplers PC1–PC3 in the voltage dividing circuit 130 are all turned off. As a result, the voltage at the point E becomes OV, thereby causing a high signal to be outputted from the output off control device 140. The high signal from the output off control device 140 deactivates the start driving circuit 40.

As hereinbefore described, according to the present invention, when the input voltage is increased, the output regulation voltage divided by the user's regulation is reduced in inverse proportion to the input voltage. As a result, the power being supplied to the working coil is always controlled at a constant value. Therefore, the output of the cooker is maintained at a constant value desired by the user although the input voltage is varied. This has the effect of enhancing a convenience in use and a system stability. Also, the output compensating circuit of the present invention is not limited to the high frequency induction heating cooker, but may be applied to electrical appliances such as a switching power supply (SMPS), in which a constant output is desired by the user.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A circuit for compensating for the output of a high frequency induction heating cooker, comprising:

rectifying means for rectifying an external AC input power into a DC power and applying the DC power to a working coil;

input current detecting means for generating a voltage proportional to a current of the AC input power;

output regulation signal generating means, responsive to the input current detecting means, for comparing the generated voltage from said input current detecting means with an output regulation voltage which is regulated by the user and for generating an output regulation signal in accordance with the compared result;

start driving means, responsive to the input current detecting means, for comparing the detected voltage from said input current detecting means with a predetermined cooker discrimination reference voltage and generating a start drive voltage in accordance with the compared result;

triangular wave generating means, responsive to said working coil, for being triggered in response to a driven state of said work coil to generate a triangular wave signal;

switching means for start-driving said working coil in response to the start drive voltage from said start driving means, comparing the output regulation signal from said output regulation signal generating means with the triangular wave signal from said triangular wave generating means and switching the driving of said working coil in accordance with the compared result;

voltage detecting means for detecting a voltage being applied from said rectifying means to said working coil and inversion-amplifying the detected voltage;

output control means for generating output regulation data according to a user's selection; and voltage dividing means for dividing an output voltage from said voltage detecting means according to the output regulation data from said output control means and outputting the divided voltage as the output regulation voltage to said output regulation signal generating means.

2. A circuit for compensating for the output of a high frequency induction heating cooker, as set forth in claim 1, wherein said output control means generates the output regulation data in response to a key signal which is generated according to the user's selection, detects the output signal from said start driving means and controls the output of the output regulation data upon the start driving of said working coil in accordance with the detected signal.

3. A circuit for compensating for the output of a high frequency induction heating cooker, as set forth in claim 1, wherein said voltage dividing means includes:

a plurality of photocouplers connected in parallel to the output of said voltage detecting means to be driven by the output regulation data from said output control means;

a plurality of resistors each connected to an output terminal of a corresponding one of said plurality of photocouplers, said plurality of resistors being of different resistances; and a condenser and a resistor connected in parallel to each other and commonly to said plurality of resistors, for cooperating to divide the output voltage from said voltage detecting means through said plurality of resistors upon the driving of said plurality of photocouplers and apply the divided voltage as the output regulation voltage to said output regulation signal generating means.

4. A circuit for compensating for the output of a high frequency induction heating cooker, as set forth in claim 1, further comprising:

off control means for comparing the output regulation voltage from said voltage dividing means with a predetermined reference voltage and disabling said start driving means upon the high frequency induction heating cooker being set to an off state in accordance with the compared result.

* * * * *